United States Patent [19]

Haag et al.

[11] 4,043,118

[45] Aug. 23, 1977

[54] PENDULUM DEVICE FOR BATTERY-POWERED CLOCKWORK MECHANISM

[75] Inventors: Albrecht Haag, Dauchingen; Roland Siefert, Bad Durrheim, both of Germany

[73] Assignee: Kienzle Uhrenfabriken GmbH, Germany

[21] Appl. No.: 629,434

[22] Filed: Nov. 6, 1975

[30] Foreign Application Priority Data

Nov. 27, 1974 Germany ..... 7439474[U]

[51] Int. Cl.[2] ..... G04B 37/00; G04B 17/00; G04B 37/12

[52] U.S. Cl. ..... 58/152 R; 58/53; 58/129

[58] Field of Search ..... 58/29, 53–56, 58/129, 130 R

[56] References Cited

U.S. PATENT DOCUMENTS

| | | | |
|---|---|---|---|
| 3,718,842 | 2/1973 | Abbott et al. | 317/101 CC |
| 3,762,154 | 10/1973 | Petrides | 58/129 |

*Primary Examiner*—E. S. Jackmon
*Attorney, Agent, or Firm*—Pollock, Vande Sande & Priddy

[57] ABSTRACT

A battery-powered clockwork mechanism and a separate pendulum unit which is detachably connected to the clockwork mechanism. When so connected the pendulum device is powered by the battery in the clockwork mechanism but operates as a "blind" pendulum which does not control or affect the time-keeping function of the clockwork mechanism.

4 Claims, 3 Drawing Figures

PENDULUM DEVICE FOR BATTERY-POWERED CLOCKWORK MECHANISM

BACKGROUND OF THE INVENTION

The present invention relates to a pendulum device or unit for use with a battery-powered clockwork mechanism. The clockwork mechanism may be of a conventional type having, for example, a balance wheel or a quartz crystal to control its timekeeping. A detachably connectable pendulum unit is provided which may readily be attached to the clockwork mechanism and, when this is done, electrical connections are provided from the battery on the clockwork mechanism to a control coil system which operates the pendulum. The pendulum operates entirely independently of the clockwork mechanism in the sense that it does not in any way control the timekeeping function of such mechanism nor is its operation affected by the timekeeping apparatus of the clockwork mechanism.

It is known in the art to provide a battery-powered pendulum clock with a permanent magnet being supported on the pendulum and cooperating with a fixed control coil which is energized to provide a driving impulse on the permanent magnet so as to maintain the oscillations of the pendulum. The oscillations of the pendulum are then transmitted to a wheel mechanism which drives the hands of the clock.

Pendulum clockworks of the kind described can only be used for certain types of clocks. Because the pendulum must have a predetermined period, it is not practical to provide different pendulum lengths with a given clockwork mechanism. Also, where the pendulum length is short, the operating characteristics of such a pendulum clock are relatively poor. Such clocks are highly sensitive to mechanical factors such as, for example, the inclination of the clock, shocks, variations in bearing friction, temperature expansion of the pendulum, etc.

It is also known in the prior art to provide a battery-powered clockwork using a so-called "blind" pendulum. In such a clock, the time-determining mechanism comprises a balance wheel swing system, and with the pendulum serving merely as a dummy pendulum. The pendulum in such clocks is driven mechanically via a wheel of the watch mechanism, the wheel being provided with pins. It is a disadvantage in the design of such clocks that only a predetermined size of pendulum can be used so that its period will be properly related to the pendulum driving mechanism operated by the clockwork. Also, in such types of pendulum clocks, the energy consumption for operating the pendulum is relative great, and the clockwork mechanism must therefore be specially designed for this.

SUMMARY OF THE INVENTION

According to the present invention, a pendulum device is provided for a battery-powered clockwork which does not require any changes in the timekeeping characteristics of the clockwork mechanism. This is accomplished by providing the pendulum device as an independent structural unit which is wholly separated functionally from the battery clockwork but is detachably connected thereto in such a way that, when connected it is energized by the battery in the clockwork housing which then provides the necessary energization for maintaining the pendulum oscillations. The pendulum device then operates as a blind pendulum in the sense that it does not function as a time-determining swing system. As a result, any desired pendulum length or pendulum shape may be used since the number of oscillations of the pendulum has no influence whatsoever on the operation of the battery clockwork.

BRIEF DESCRIPTION OF THE DRAWINGS

In describing this invention, reference will be made to the accompanying drawings in which.

DETAILED DESCRIPTION OF THE PREFERRED EMBODIMENT

Figure 2:
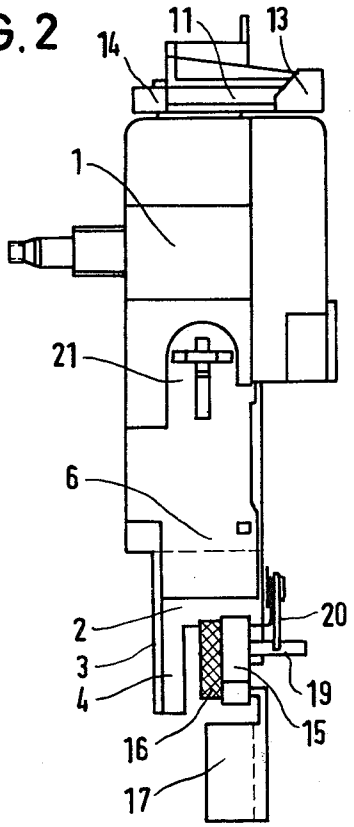
FIG. 2 is a left side view of the apparatus of FIG. 1.
Figure 3:
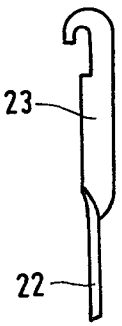
FIG. 3 shows the upper end of the pendulum rod.
Figure 1:
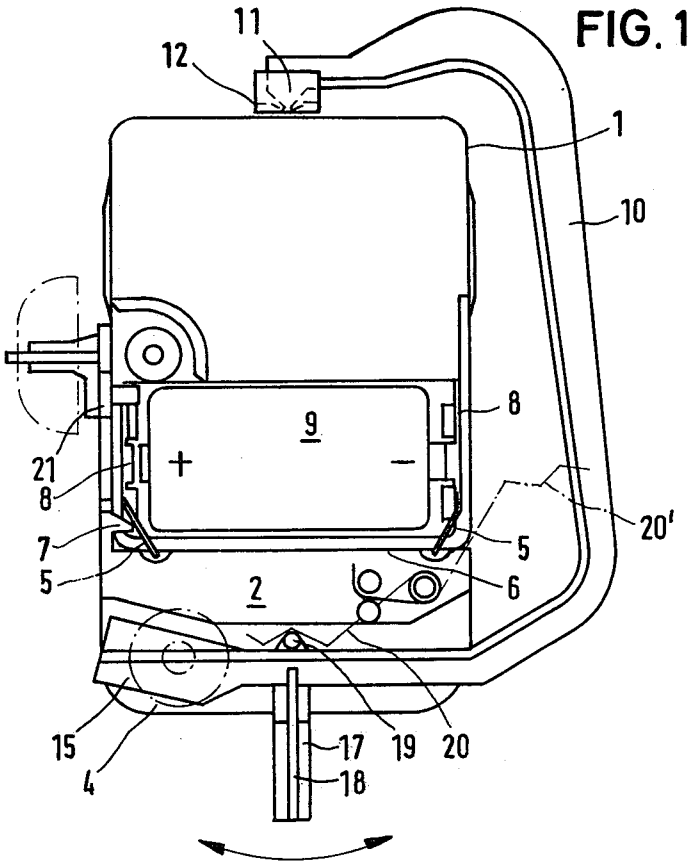
FIG. 1 shows a rear view of a battery clockwork with a pendulum device according to the present invention.

In FIGS. 1 and 2, the battery-powered clockwork is included within a housing 1 which, in its lower portion, has a recess for a battery 9. The electrical connection between battery 9 and the battery-powered clockwork is provided via battery retaining springs 8. The frequency-determining portion of the battery clockwork 1, for example, can be provided by a balance-wheel swing system, but it is apparent that a quartz crystal controlled swing system may also be employed.

Along the underside portion 6 of the battery clockwork housing 1 is provided a housing 2 for a pendulum unit which may be detachably connected to the housing 1 by connections 7 which may be of the type known as a "click-stop" connection means. In FIG. 1, only the left-hand click-stop connection 7 has been shown for greater clarity, but it will be understood that an identical or similar connection may be provided on the right-hand side as well.

On the housing 2 of the pendulum device a conductor plate 3 is provided, and this plate supports a coil means 4. Such coil means 4 may comprise a control coil and a drive coil, and additional electrical components may also be supported on the conductor plate.

Electrical connection of the conductor plate 3 to battery 9 is provided by means of connecting wires and knife-blade contacts 5 which connect with the battery-retaining springs 8 so as to provide thereby energization from the battery 9 to the electrical apparatus supported on the plate 3. It is possible, according to an alternative arrangement, to provide that the contacts 5 will not only provide for electrical connection from the battery 9 to the detachably connected pendulum device but that they will also provide physical support therefore in which event it is then not necessary to provide also the connection means 7 shown in FIGS. 1 and 2.

The pendulum device comprises a U-shaped pendulum clip member 10. Such pendulum clip 10 at its upper end includes a bearing edge 11 which is pivotally supported on a bearing portion 12. Such bearing portion 12 is attached to the uppermost surface of the housing 1 by any convenient means, and such bearing portion may be provided as well with lateral and frontal raised wall portions 13 and 14 to facilitate the suspension of the pendulum clip 10 and thereby tend to prevent the pendulum clip 10 from inadvertently becoming disengaged from the bearing 12.

On the lower shank of pendulum clip 10 is provided a suspension means 17 for the pendulum rod 22 and also a supporting means 15 for permanent magnet 16. When the pendulum is in the at-rest position, permanent magnet 16 lies generally opposite the coil means 4.

A retaining pin 19 is provided on the pendulum clip 10. During transport of the clock, for example, the retaining pin 19 can be engaged by retaining spring 20 which is supported on housing 2. During operation of the pendulum, the spring 20 is moved to the position 20' shown in FIG. 1.

As shown in the side view of FIG. 2, the plane of the pendulum clip 10 is approximately in the median plane of the clockwork mechanism 1. The upper portion of the pendulum rod 23 is supported within a groove 18 in member 17. The walls of the groove 18 rest against the upper portion 23 of pendulum rod 22, although the pendulum rod 22 can be adjusted in the groove 18 laterally with respect to the pendulum plane. This latter feature makes it possible for the pendulum plane to always be maintained in the vertical plane even when the clock is inclined from the horizontal. As a result, it is possible to prevent the pendulum bearing 11 and 12 from being bound in such a way as to interfere with proper swinging of the pendulum. Thus, tilted positions of the clockwork both in the plane of the pendulum swing and laterally to such plane then have no influence on its proper operation.

A fastening means 21 is also provided on housing 2 to support a gong mechansim if desired.

What we claim is:

1. An electrically operated clockwork mechanism having a pendulum comprising:

a first housing comprising a battery supporting means and time-keeping means energized by a battery, a second housing detachably connected to said first housing and including a pendulum, a permanent magnet supported on the pendulum and a fixed electrical coil means, said pendulum including a pendulum clip which is U-shaped and embraces within its open mouth the assembled combination of said first and second housings, with a first leg thereof supported pivotally adjacent one end thereof on an upper surface of said first housing and with the second leg thereof underlying said second housing which is positioned below said first housing, and connecting means effective in response to the connection of said second housing to said first housing to connect said battery to said electrical coil, said time-keeping means on said first housing operating independently of said pendulum.

2. The clockwork mechanism of claim 1 wherein said second leg supports said permanent magnet.

3. The clockwork mechanism of claim 1 wherein said second housing includes a connector plate which fixedly supports said electrical coil.

4. The clockwork mechanism of claim 1 which further includes a pendulum rod detachably connected to said pendulum clip.

* * * * *